United States Patent [19]

Ingvason

[11] Patent Number: 4,815,995

[45] Date of Patent: Mar. 28, 1989

[54] SHIPS PROPULSION

[76] Inventor: Sigurdur Ingvason, Gärdesvägen 31, S-430 80 Hovås, Sweden

[21] Appl. No.: 108,556

[22] Filed: Oct. 15, 1987

[51] Int. Cl.[4] ..... B63H 5/14

[52] U.S. Cl. ..... 440/66; 114/56

[58] Field of Search ..... 114/56, 57; 440/66, 440/1, 70, 49; 294/129.1

[56] References Cited

U.S. PATENT DOCUMENTS

| | | | |
|---|---|---|---|
| 867,654 | 10/1907 | Golden | 114/57 |
| 1,401,963 | 1/1922 | Criqui | 440/69 |
| 2,581,625 | 1/1952 | Brady | 244/129.1 |
| 2,929,586 | 3/1960 | Hurd, Jr. et al. | 244/129.1 |
| 4,509,925 | 4/1985 | Wuhrer | 440/67 |

*Primary Examiner*—Joseph F. Peters, Jr.
*Assistant Examiner*—Edwin L. Swinehart
*Attorney, Agent, or Firm*—Burns, Doane, Swecker & Mathis.

[57] ABSTRACT

A ship's propeller is mounted so its blades will rotate closer to the shell plating of the adjacent hull, than is generally considered advantageous. A recess is formed inside the shell plating in the region of the propeller, the recess having a depth locating its inward wall at a distance from the tips of the rotating propeller blades corresponding to about 25% of the propeller diameter. The recess can be provided with a number of spaced-apart, transverse bars having a height less than the maximum depth of the recess.

3 Claims, 2 Drawing Sheets

SHIPS PROPULSION

BACKGROUND OF THE INVENTION

A rotating ship's propeller can cause considerable noise and vibrations, and is also subjected to severe cavitation. One step to meet these problems is to mount the propeller so its blades will pass at a distance from the adjacent parts of the ship's hull corresponding to about 25% of the propeller diameter.

That will impose certain restrictions upon the propulsion equipment, which, taking other specifications into account, may mean a reduced propeller diameter and/or an increased rotational speed.

SUMMARY OF THE INVENTION

An object of the present invention is to propose a propulsion arrangement, which increases the propulsive efficiency while maintaining low influence of noise, vibrations and cavitation.

In a ship having a hull including an aft body defined by shell plating and supporting at least one multi-bladed propeller rotatable about a generally horizontal shaft, the propeller shaft is mounted so the tips of the propeller blades will move closer to the hull plating than corresponds to 25% of the propeller diameter, and inside the hull plating and adjacent to the plane of rotation of the propeller a recess is formed, which inwardly is defined by a wall located at about 25% of the diameter of said propeller away from the path of the rotating propeller blades.

The recess can be provided with a number of spaced-apart flat-bar beams having a height which is less than the depth of the recess. These bars may be mounted generally parallel to the plane of rotation of the propeller or slightly inclined thereto. The recess may be at least partly filled with a resilient compound.

DESCRIPTION OF THE PREFERRED EMBODIMENTS

Figure 1:
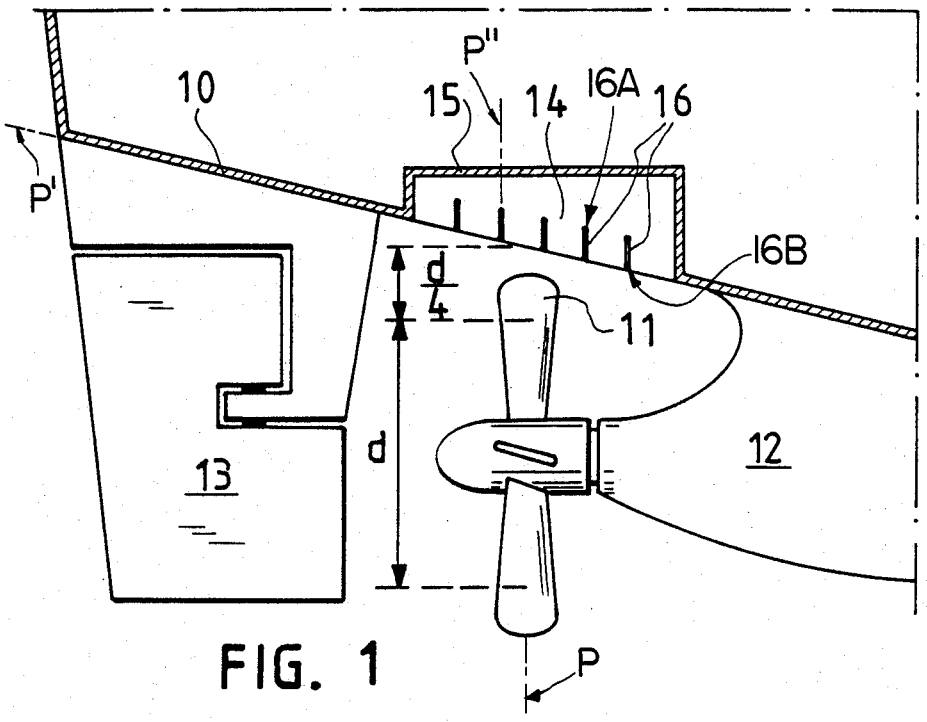
FIG. 1 shows a side view of a portion of the aft body of a ship according to the invention.
Figure 2:
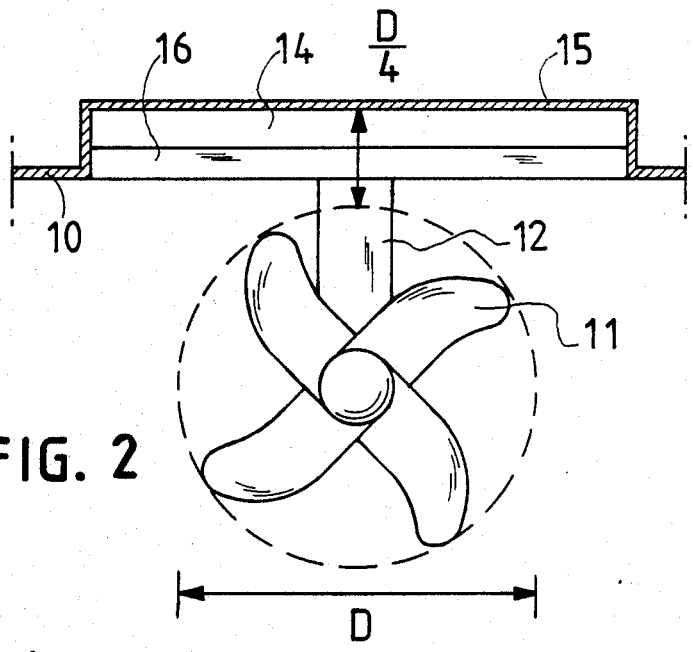
FIG. 2 shows a view of the propeller and adjacent portion of the hull, as viewed from abaft.

FIG. 1 shows a portion of the aft body of a ship, which may be a single screw vessel, or a twin screw vessel with a plane, upwardly rising underwater body.

The hull is defined by shell plating 10, and a multi-bladed propeller 11 is mounted in a skeg 12 enclosing the propeller shaft, which is substantially horizontal.

A rudder 13 is mounted abaft the propeller, in a single screw vessel aligned with the propeller. In a twin screw vessel a single rudder may be mounted between the two propellers, or there may be a rudder aligned with each propeller.

The propeller 11 has a diameter D, and is mounted so its blades will rotate closer to the shell plating than is normally considered necessary with respect to the occurrence of noise, vibrations and cavitation.

Instead a recess 14 is formed inside the shell plating, extending in the longitudinal direction somewhat ahead and abaft of the propeller. A portion of the interior wall 15 of the recess is intersected by a plane P of the propeller blades. The depth of this portion of the recess relative to the plane P′ of the shell plating should be sufficient to locate its inside wall 15 at a distance from the path of the rotating propeller blades corresponding to 25% of the propeller diameter, thereby meeting the general requirements for abating noise, vibrations and cavitation.

It is evident, that a propeller rotating about the same shaft and having blades passing at a distance of 25% of its diameter from the shell plating would have a much smaller diameter than D. The smaller diameter d, and the corresponding distance d/4 are indicated in FIG. 1. This would for the same propulsion load necessitate a higher speed, which, in turn, could raise the level of noise, vibrations and cavitation.

In the longitudinal direction the recess 14 is subdivided by a number of spaced-apart flat bar beams 16, having a height smaller than the maximum depth of the recess. Each of the beams defines a plane P″ disposed transversely relative to the propeller shaft. In FIG. 1, the plane P″ is depicted perpendicular to the shaft. Each bar has a first edge 16A facing the interior wall 15, and a second edge 16B facing the propeller shaft. The second edges 16B lie in the plane P′ of the shell plating as shown in FIG. 1. These beams will reduce turbulence within the recess, and are here oriented parallel to the plane of rotation of the propeller.

The depth of the recess ensuring the 25% distance from the propeller blade should apply at least in the plane of the propeller. Variations in the depth, forward and abaft this plane will tend to smooth-out the input upon the hull of the water thrown ontowards by the propeller.

Figure 3:
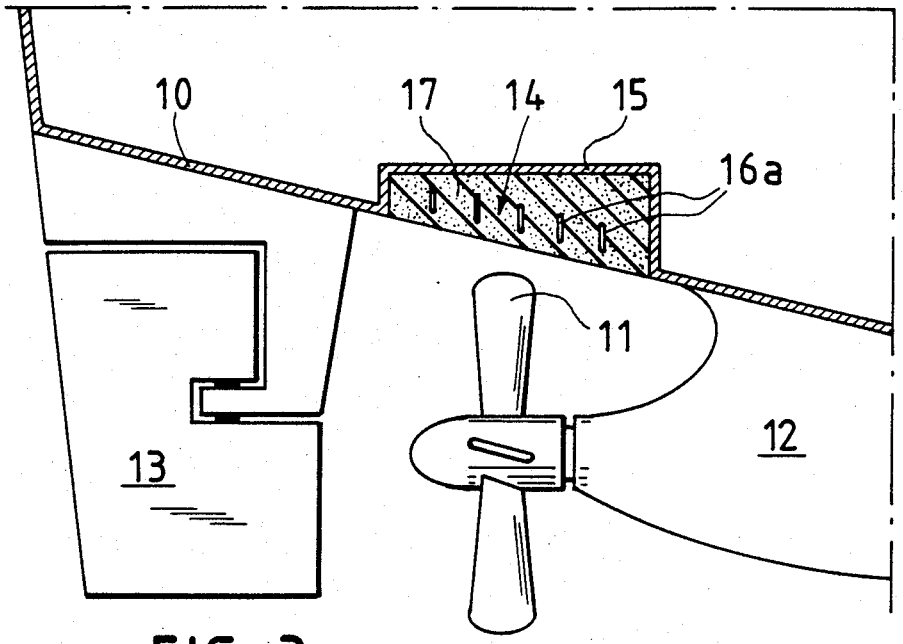
FIG. 3 is a view corresponding to that in FIG. 1, but with a modified design of the recess.

FIG. 3 shows a modified design of the recess 14. The same reference numerals as in FIG. 1 are used. The beams **16*a* have here somewhat less height than in FIG. 1, and are located inside the contour of the shell plating 10**. This will tend to reduce the resistance to flow past the recess.

A manner of further reducing noise and vibrations is to fill the recess 14, at least partly, with some resilient or spongy compound 17.

Figure 4:
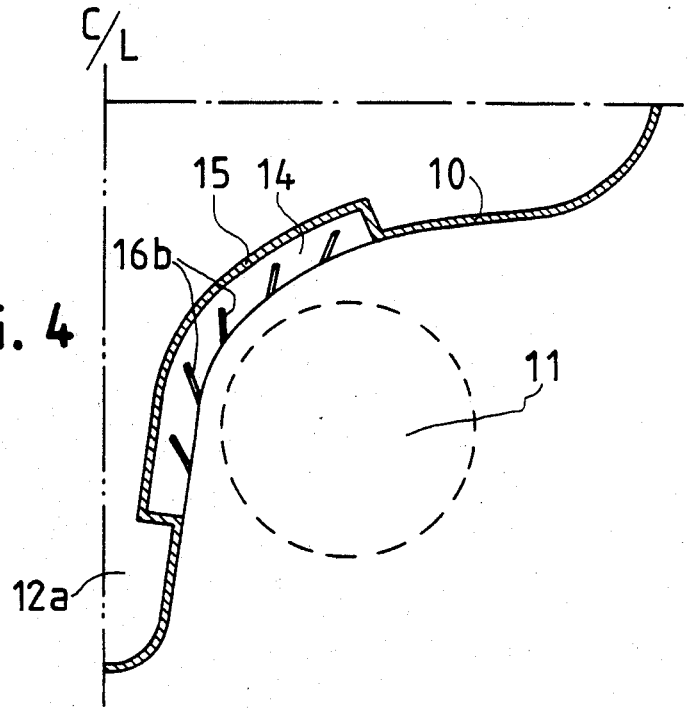
FIG. 4 shows a view, as seen from abaft, of a portion of a twin-screw vessel.

FIG. 4 shows part of the aft body of a twin screw vessel, where the skeg **12*a*** projects between the propellers. The same reference numerals as in the previous figures are used whenever applicable.

The recess 14 is here located sidewardly with respect to the propeller 11, extending down into the skeg **12*a*. The beams 16*b*** are here located at an angle to the plane of rotation of screw, which facilitates the flow of water thrown outwards by the propeller blades. The angular position is, however, not specific to this twin screw arrangement, but may be used in the other recesses also.

The recesses may be formed in different ways, taking the minimum depth into consideration, and various combinations of recess and beams are possible within the scope of the appended claims.

I claim:

1. In a ship having a hull including an aft body defined by shell plating and supporting at least one multi-bladed propeller rotatable about a generally horizontal shaft, said shell plating generally defining a plane, means for mounting said shaft such that tips of the propeller blades traverse a path of travel spaced from said plane of said shell plating by less than 25% of the propeller diameter, a recess formed in said hull plating so as to be recessed relative to said plane in a direction away from said propeller, said recess disposed adjacent a plane of rotation defined by said propeller blades, said recess including an interior wall spaced inwardly from said plane of said shell plating to define a depth of said recess, a portion of said interior wall being intersected by said plane of said blades, said wall portion being spaced from said path of travel by a distance of about 25 percent of said propeller diameter, a plurality of turbulence-reducing beams disposed in said recess and defining planes disposed transversely of said shaft, each of said bars having first and second edges, said first edges facing said inner wall and said second edges facing said shaft, said second edges lying generally in said plane of said shell plating, a distance between said first and second edges being less than a maximum depth of said recess.

2. A ship according to claim 1, wherein said beams defined planes disposed perpendicularly to said shaft.

3. A ship according to claim 1, wherein said first bars are inclined relative to said plane of said blades.

* * * * *